United States Patent [19]

Arai et al.

[11] Patent Number: 4,850,895

[45] Date of Patent: Jul. 25, 1989

[54] COAXIAL CABLE CONNECTION ASSEMBLY WITH A TRANSCEIVER

[75] Inventors: Katsuyuki Arai, Narita; Kenji Karai, Sakura; Okosu Watanabe, Chiba; Keiji Ando, Yotsukaido, all of Japan

[73] Assignee: Fujikura Ltd., Tokyo, Japan

[21] Appl. No.: 151,885

[22] Filed: Feb. 3, 1988

[30] Foreign Application Priority Data

Sep. 10, 1987 [JP] Japan ..... 62-138497[U]

[51] Int. Cl.[4] ..... H01R 4/24

[52] U.S. Cl. ..... 439/394; 439/582

[58] Field of Search ..... 439/391, 393, 394, 581, 439/582

[56] References Cited

U.S. PATENT DOCUMENTS

| | | | |
|---|---|---|---|
| 3,176,230 | 3/1965 | Collins | 455/6 |
| 4,120,554 | 10/1988 | Bianchi | 339/97 R |
| 4,266,842 | 5/1981 | Dillon, Jr. et al. | 339/97 P |
| 4,588,249 | 5/1986 | Blichasz et al. | 439/394 |
| 4,624,520 | 11/1986 | Blum | 439/394 |
| 4,746,307 | 5/1988 | Joby et al. | 439/394 |

FOREIGN PATENT DOCUMENTS

| | | | |
|---|---|---|---|
| 2082850 | 3/1982 | United Kingdom | 439/394 |

*Primary Examiner*—P. Austin Bradley

*Attorney, Agent, or Firm*—Frishauf, Holtz, Goodman & Woodward

[57] ABSTRACT

A coaxial cable connection assembly includes a cable tap connector for engaging with the coaxial cable, a transceiver for transmitting and receiving information signals to and from the coaxial cable via the cable tap connector, a drop cable connector for electrically connecting the transceiver to a station device, and two matable coupling members for engaging and electrically connecting the transceiver with the cable tap connector. The tap connector has an axis along which the coaxial cable is disposed when the connector is engaged with the coaxial cable. The tap connector also has an outer face substantially parallel to the axis thereof, and includes outer and center conductor contact members for respective electrical connections with the outer and center conductors of the coaxial cable. The transceiver includes a casing having first and second intersecting faces. The drop cable connector is mounted on the first face of the transceiver. The coupling members have circular or equilateral polygonal cross sections, and are mounted respectively on the outer face of the cable tap connector and on the second face of the transceiver. When the coupling members are mated together, the second face of the transceiver confronts the outer face of the cable tap connector, and the angle of the first face of the transceiver with respect to the axis of the cable tap connector is adjustable.

10 Claims, 6 Drawing Sheets

COAXIAL CABLE CONNECTION ASSEMBLY WITH A TRANSCEIVER

BACKGROUND OF THE INVENTION

This invention relates to a coaxial cable connection assembly used for the Local Area Network, in particular, for a network such as Ethernet which utilizes a coaxial cable as a transmission medium, and more specifically, the invention relates to a connection assembly for electrically connecting the coaxial cable used in the network to each of the station devices such as transmitting and/or receiving devices and other units.

FIG. 1 schematically illustrates a typical example of Ethernet which is a kind of bus network. Reference numeral 20 designates a coaxial cable which serves as a transmission line for transmitting information signals. This coaxial cable 20 is provided at its opposite ends with terminators 21 and is connected to a plurality of station devices 22 such as personal computers and the like via the same number of drop cables 32. A cable connection assembly 24 couples each of the drop cables 32 to the coaxial cable 20 so that the station devices 22 are enabled to transmit and/or receive information signals to and/or from one another.

As shown in FIG. 2, each of the cable connection assemblies 24 includes: a cable tap connector 26 for engaging with the coaxial cable 20; and a transceiver 28, fixedly connected to the cable tap connector 26, for transmitting and receiving information signals to and from the coaxial cable 20 and for controlling the transmission and reception of the information signals. The transceiver 28 has a drop cable-connecting member 30, disposed on the outer surface 29 of the transceiver 28, for coupling the transceiver 28 to the corresponding drop cable 32 which is connected to the controlling circuit board (not shown) in the corresponding station device 22.

The cable tap connector 26 comprises two matable housing members 34 and 36. The housing member 34 is directly and fixedly connected to the transceiver 28, while the other housing member 36 is adapted to be mated with or secured to the housing member 34 by means of screws 46. The housing members 34 and 36 have respective semi-cylindrical channels 44 and 45 formed therein which coincide when the housing members 34 and 36 are mated to form one full cylindrical channel for receiving and retaining the coaxial cable 20. As illustrated in FIGS. 3 and 4, the housing member 34 has a center conductor probe 38 and outer conductor contact pins 40 and 42. Both the probe 38 and the pins 40 and 42 are made of metal and extend into the channel 44 to contact the respective center and outer conductors of the cable 20 as the housing members 34 and 36 are mated. Dielectric material 48 fits around the central section of the center conductor probe 38 so that the probe 38 is electrically insulated from the housing member 34 and that opposite end portions of the probe 38 are exposed.

The coaxial cable 20 has a bore 49 extending radially through its sheath, its outer conductor and its insulation so that the center conductor of the cable 20 is exposed through the bore 49. The center conductor probe 38 is adapted to be inserted into this bore 49 to be electrically in contact with the center conductor of the cable 20. The outer conductor contact pins 40 and 42 are adapted to penetrate the sheath of the cable 20 to electrically contact the outer conductor of the cable 20 as the probe 38 is inserted into the bore 49. As shown in FIG. 4, each of the probe 38 and the pins 40 and 42 is electrically connected to an electric circuit board 50 of the transceiver 28 via a lead wire 51. This electric circuit board 50 is connected to the connecting member 30 to which the drop cable 32 is to be coupled. With the assist of the cable connection assembly thus constructed, the station devices are ready to transmit and receive information signals to and from one another through the coaxial cable 20.

However, there arises the following inconvenience with the aforementioned cable connection assembly 24: that is, it is difficult to dispose the drop cable 32 flexibly in a desired direction such as a direction parallel to the coaxial cable 20 since the transceiver 28 is fixedly connected to the cable tap connector 26 so that its outer surface 29, on which the drop cable-connecting member 30 is mounted, is retained in parallel relationship to the axis X of the full cylindrical channel of the tap connector 26. For example, as shown in FIG. 2, the drop cable 32 does not naturally extend parallel to the coaxial cable 20 but perpendicular to the coaxial cable 20. In other words, the direction in which the drop cable 32 extends from the transceiver 28 is unnecessarily predetermined by the position of the connecting member 30 with respect to cable tap connector 26. Consequently, it is often necessary, for instance, when the branch connection including the connection assembly 24 is required to be encased in a joint box 47 as shown in FIG. 5, to bend the drop cable 32 at an undesirably small bend radius or to prepare a space-occupying large joint box.

SUMMARY OF THE INVENTION

Accordingly, it is an object of the present invention to provide a coaxial cable connection assembly which enables the drop cable, without bending it, to be disposed in a desired direction with respect to the coaxial cable, whereby the efficiency of the cable connecting operation is considerably enhanced.

With this and other objects in view, the present invention provides a coaxial cable connection assembly comprising: a cable tap connector for engaging with the coaxial cable; a transceiver for transmitting and receiving information signals to and from the coaxial cable via the cable tap connector, the transceiver including a casing having first and second intersecting faces; a drop cable-connecting member, mounted on the first face of the transceiver, for electrically connecting the transceiver to the station device; and first and second matable coupling means mounted respectively on the outer face of the cable tap connector and on the second face of the transceiver, the outer face of the tap connector being substantially parallel to the axis of the full cylindrical channel of the cable tap connector. The first coupling means comprises: a first tubular outer terminal member electrically connected to one of the outer and center conductor contact members of the cable tap connector; and a first rod-like center terminal member coaxially disposed in the first outer terminal member and electrically connected to the rest of the outer and center conductor contact members of the cable tap connector. The second coupling means comprises: a second tubular outer terminal member for coaxial and electrical connection with the first outer terminal member when the first and second coupling means are mated together; and a second rod-like center terminal member, coaxially disposed in the second outer terminal member, for coaxial and electrical connection with the first center terminal member when the first and second coupling means are mated together. The second outer and center terminal members are electrically connected to the transceiver. With this construction, when the first and second coupling members are mated, the transceiver is engaged and electrically connected with the cable tap connector so that the second face of the transceiver confronts the outer face of the cable tap connector and that the angle of the first face of the transceiver with respect to the axis of the cable tap connector's channel is adjustable. Therefore, the cable connection assembly according to the present invention facilitates the laying of the drop cable in a desired direction with respect to the coaxial cable.

It is preferred that one of the first and second center terminal members is of a tubular configuration so that the remainder of the first and second center terminal members coaxially fits in the one of the first and second center terminal members when the first and second coupling means are mated together. It is also preferred that one of the first and second outer terminal members has a transverse outer size such that the one of the first and second outer terminal members coaxially fits in the remainder of the first and second outer terminal members when the first and second coupling means are mated together.

The first and second outer terminal members and the first and second center terminal members may have circular cross sections so that the first and second coupling means are rotatable with respect to each other when the first and second coupling means are mated together. With such a construction, the transceiver member is turnable about the axis of the terminal members when the transceiver is engaged with the cable tap connector.

Alternatively, the first and second outer terminal members may have similar equilateral polygonal cross sections so that the first and second coupling means are matable with each other in more than three kinds of angular relationships.

Preferably, the coaxial cable connection assembly according to the present invention has means for securing the transceiver to the cable tap connector so that the first and second coupling means are retained in mating relation and that the angle of the first face of the transceiver with respect to the axis of the cable tap connector is retained in a specific angle. The securing means may include: a insulation plate member, attached to the outer face of the cable tap connector, for electrically insulating the outer face of the tap connector from the second face of the transceiver; and attaching means for detachably attaching the insulation plate member to the second face of the transceiver.

DETAILED DESCRIPTION OF THE PREFERRED EMBODIMENT

Figure 1:
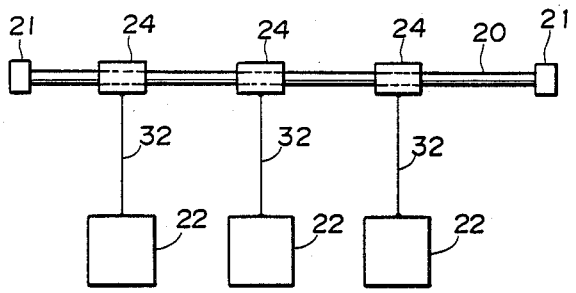
FIG. 1 (PRIOR ART)
FIG. 1 is a schematic drawing showing a typical example of Ethernet.
Figure 2:
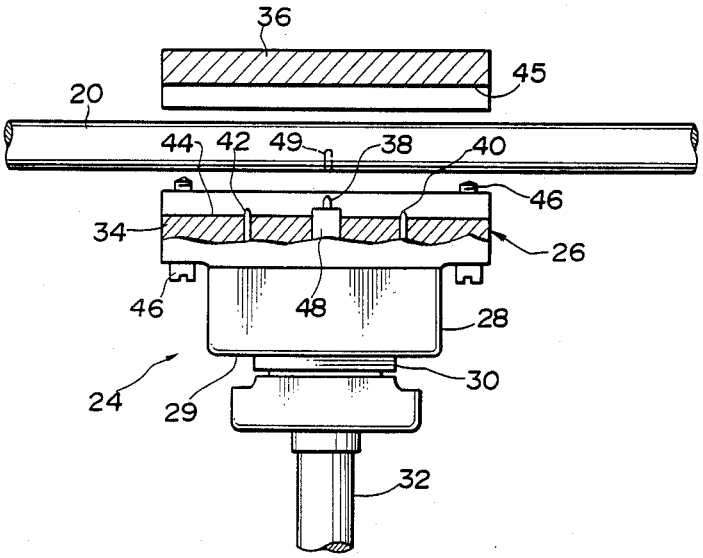
FIG. 2 (PRIOR ART)
FIG. 2 is a plan view partly in section of a conventional coaxial cable connection assembly with parts in an assembled condition prior to connection on to a coaxial cable.
Figure 3:
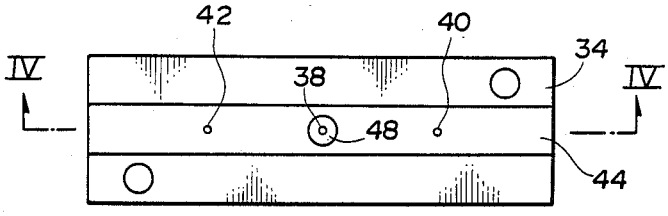
FIG. 3 (PRIOR ART)
FIG. 3 is a rear view of a housing member of the cable connection assembly in FIG. 2, which has a semicylindrical channel, a center conductor probe and a outer conductor contact pins.
Figure 4:
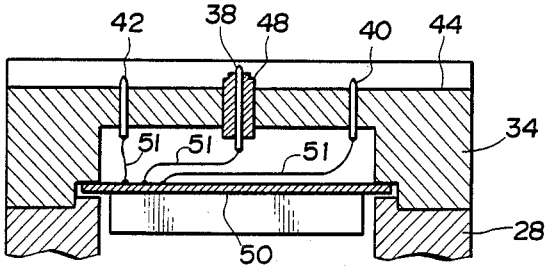
FIG. 4 (PRIOR ART)
FIG. 4 is a view taken along the line IV—IV in FIG. 3.
Figure 5:
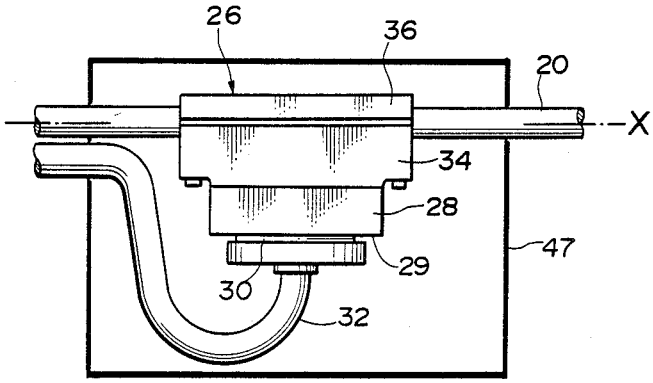
FIG. 5 (PRIOR ART)
FIG. 5 is a plan view, similar to FIG. 2, of the conventional cable connection assembly connected to the coaxial cable and encased in a joint box.

Referring now to FIGS. 6 to 15, the same parts as those in FIGS. 1 to 5 are designated by the same reference numerals, and descriptions thereof will be omitted.

Figure 6:
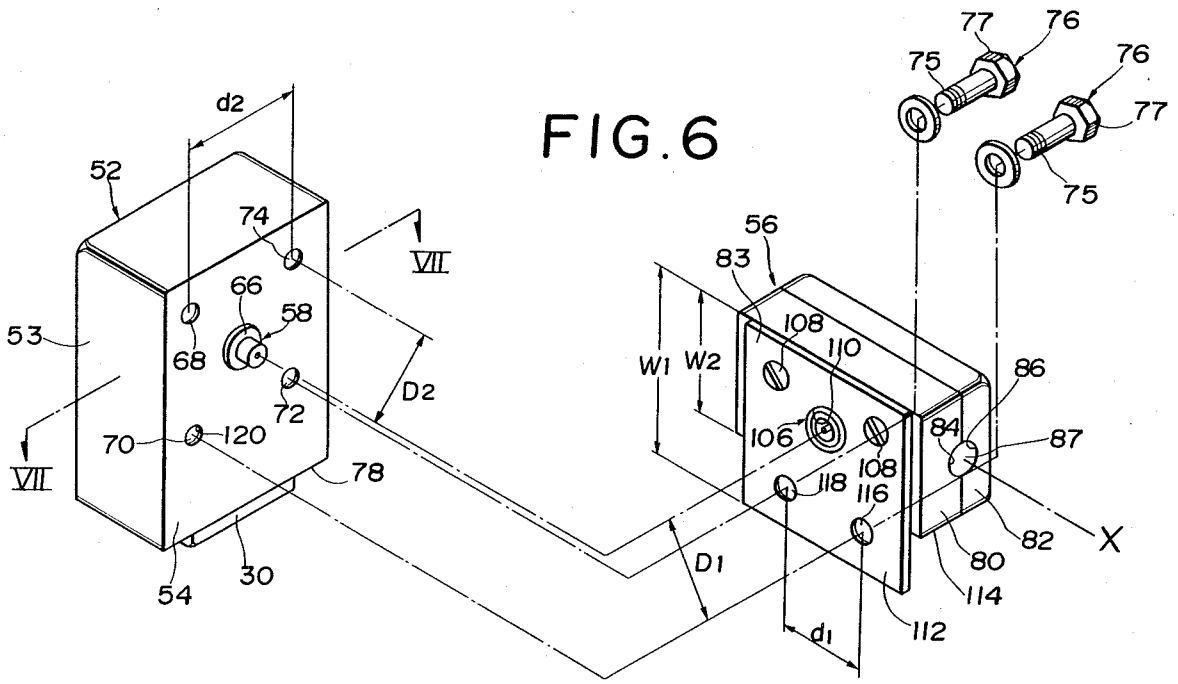
FIG. 6 is an exploded and perspective view of the parts of a coaxial cable connection assembly according to the present invention.
Figure 7:
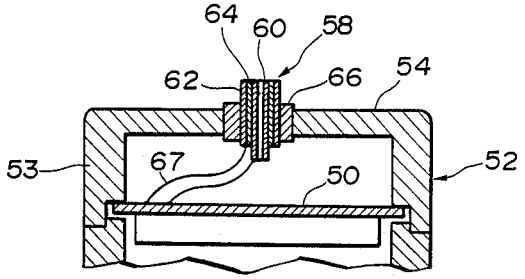
FIG. 7 is a fragmentary view taken along the line VII—VII in FIG. 6.

FIG. 6 illustrates a coaxial cable connection assembly according to the present invention, in which a transceiver 52 has a casing 53 of a rectangular configuration. One of the side faces of the casing 53 serves as a mating face 54 to be mated with a cable tap connector 56. This mating face 54 is provided with second coupling means in the form of a push on-type receptacle 58 protruding from substantially central portion of the mating face 54. As shown in FIG. 7, the entire receptacle 58 is of a cylindrical configuration and comprises a round tubular center terminal 60, a second hollow cylindrical outer terminal 62 coaxially surrounding the center terminal 60 and a insulating member 64 interposed between the center and outer terminals 60 and 62. The outer terminal 62 is attached to the casing 53 of the transceiver 52 via a gasket member 66 which is made of dielectric material such as synthetic rubber so that the outer terminal 62 is electrically insulated from the casing 53. By means of lead wires 67, both the center and outer terminals 60 and 62 are connected to a electric circuit board 50 which is contained in the casing 53.

The mating face 54 is also provided with four circular threaded holes 68, 70, 72 and 74 formed therein, so that the threaded end portions 75 of screws or bolts 76 are engaged with the inner faces 120 of the threaded holes 68, 70, 72 and 74 in order to secure the transceiver 52 to the cable tap connector 56. All these threaded holes have equal inner diameters and are arranged around the receptacle 58 at such positions that distances $D_2$ between the center axis of the receptacle 58 and the centers of the respective threaded holes 60, 70, 72 and 74 are equal to one another. That is, the threaded holes 68, 70, 72 and 74 are disposed on the periphery of an imaginary circle. In this embodiment, the threaded holes are arranged in such a manner that they designate the four corners of an imaginary square as best shown in FIG. 8.

One of the other faces substantially perpendicular to the mating face 54, e.g., the lower face 78 of the casing 53 is provided with a drop cable-connecting member in the form of a drop cable connector 30 for coupling the transceiver 52 to a drop cable 32. This drop cable connector 30 is electrically connected to the electric circuit board 50 by lead wires (not shown).

The cable tap connector 56 comprises first and second matable housing members 80 and 82 and a substantially square insulation plate 83. The housing members 80 and 82 are made of conductive metal and is of a substantially rectangular configuration when they are mated together. Also, the housing members 80 and 82 contain semi-cylindrical channels 84 and 86 respectively, which forms a resultant full cylindrical channel 87 when the housing members 80 and 82 are mated with each other. The second housing member 82 is detachably securable to the first housing member 80 by means of screws.

Figure 8:
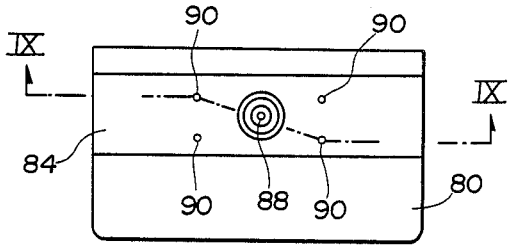
FIG. 8 is a rear view of a first housing member of the cable connection assembly in FIG. 6.
Figure 9:
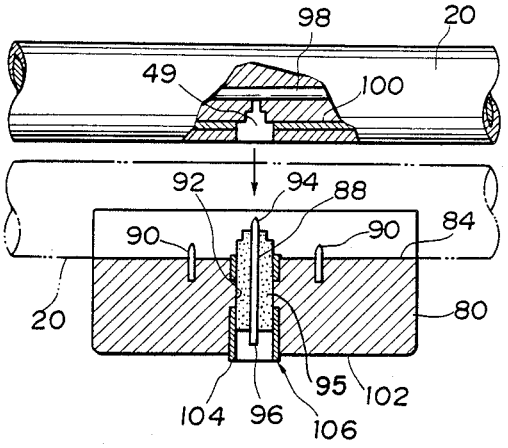
FIG. 9 is a view taken along the line IX—IX in FIG. 8.

As illustrated in FIGS. 8 and 9, the first housing member 80 has a circular mounting hole 92 extending between the inner face of the channel 84 and the outer face 102 of the first housing member 80. A center conductor probe 88 which has a dielectric material 95 such as polyethylene fitting therearound, fits firmly in the mounting hole 92 so that the exposed end portion 94 of the center conductor probe 88 projects into the semi-cylindrical channel 84. The other exposed end portion 96 of the center conductor probe 88 is disposed within the mounting hole 92. Four outer conductor contact pins 90 are arranged on the first housing member 80 symmetrically about the axis of the center conductor probe 88. The proximal ends of these pins 90 are embedded in the housing member 80 so that distal ends thereof extend into the channel 84.

A hollow cylindrical conductive member 104 coaxially fits in the mounting hole 92 in such a manner that the sleeve 104 surrounds the exposed end portion 96 of the center conductor probe 88. This conductive member 104 has an inner diameter generally equal to the outer diameter of the outer terminal 62 of the receptacle 58 so as to fit around the outer terminal 62, and the end portion 96 has an outer diameter generally equal to the inner diameter of the center terminal 60 of the receptacle 58 so as to fit in the center terminal 60. As a result of this construction, there is formed on the outer face 102 of the first housing member 80, first coupling means in the form of an electric plug 106 to be mated with the receptacle 58 of the transceiver 52. This plug 106 is constituted of a round rod-like center terminal in the form of the end portion 96 of the center conductor probe 88 and a first hollow cylindrical outer terminal in the form of the cylindrical conductive member 104. In this condition, it is apparent that the outer conductor contact pins 90 are in electrical connection with the cylindrical conductive member 104 via the metal housing member 80.

Returning to FIG. 6, the insulation plate 83 is secured to the outer face 102 of the first housing member 80 by means of screws 108. This insulation plate 83 is made of dielectric substance such as a ceramics and the like and has a central through hole 110 at its portion confronting the plug 106 so that the plug 106 is exposed. Also, this insulation plate 83 has a width $W_1$ larger than width $W_2$ of the first housing member 80, resulting in an extension portion 112 extending downward from the lower face 114 of the first housing member 80. This extension portion 112 has two apertures 116 and 118 formed therein at such positions that the distance $D_1$ between the axis of the plug 106 and either of the centers of the apertures 116 and 118 are equal to the distance $D_2$. Also, the distance $d_1$ between the two apertures 116 and 118 is equal to the distance $d_2$ between any two adjoining threaded holes of the transceiver 52. That is, when the plug 106 is engaged with the receptacle 58 of the transceiver 52, the apertures 116 and 118 are potential to be aligned with any two adjoining threaded holes of the transceiver 52, and thereby the cable tap connector 56 is securable to the transceiver 52 by means of the bolts 76 passing through the apertures 116 and 118 and threadedly engaging with corresponding inner faces 120 of threaded holes. It should be apparent that the head portion 77 of each of the bolts 76 has a larger transverse outer size than the inner diameter of each of the apertures 116 and 118 so that the head portions 77 is capable of engaging with the peripheral portion 122 of each of the apertures.

Figure 10:
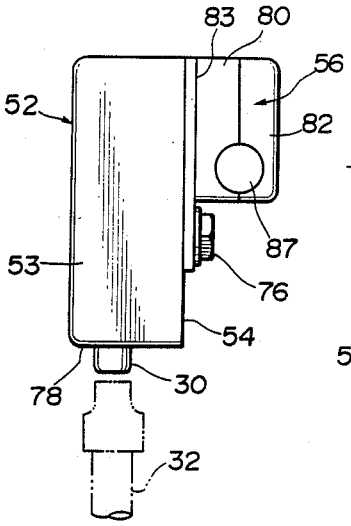
FIG. 10 is a side-elevational view of the cable connection assembly connected to a coaxial cable.
Figure 11:
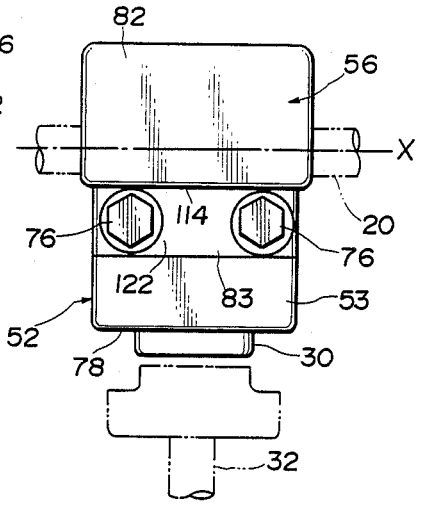
FIG. 11 is a front view of the cable connection assembly in FIG. 10.

In operation, the first housing member 80 is positioned against a coaxial cable 20 so that the section of the cable 20 having a bore 49 is positioned within the channel 84 and that the center conductor probe 88 is inserted into the bore 49 as best shown in FIG. 9. The second housing member 82 is secured to the first housing member 80 whereby the coaxial cable 20 is engaged with and retained in the cylindrical channel 87, which results in electrical connection of the center conductor probe 88 with the center conductor 98 of the cable 20 and simultaneously in electrical connection of the outer conductor contact pins 90 with the outer conductor 100 of the cable 20. The transceiver 52 is positioned against the insulation plate 83 with its mating face 54 confronting the insulation plate 83, and then the receptacle 58 of the transceiver 52 is engaged with the plug 106 of the first housing member 80. This engagement results in electrical connection of the first center terminal 96 of the plug 106 with the second center terminal 60 of the receptacle 58 and also in electrical connection of the first outer terminal 104 of the plug 106 with the second outer terminal 62 of the receptacle 58. Next, the transceiver 52 is turned about the axis of the receptacle 58 with respect to the tap connector 56 to make a proper angle $\theta$ (see FIG. 13) of its lower face 78 relative to the axis X of the channel 87 of the tap connector 56, that is, to orient its lower face 78 in a direction suitable for disposing the drop cable in a desired direction. Suitable two adjoining threaded holes, e.g., the threaded holes 70 and 72 are aligned with the respective apertures 116 and 118 of the insulation plate 83, and as shown in FIGS. 10 and 11, the bolts 76 are screwed in the threaded holes 70 and 72 through the respective apertures 116 and 118. The transceiver 52 is thereby firmly secured to the cable tap connector 56. After that, a drop cable 32 is coupled to the drop cable connector 30, which results in the completion of electrical connection of the the coaxial cable 20 with a station device.

Figure 12:
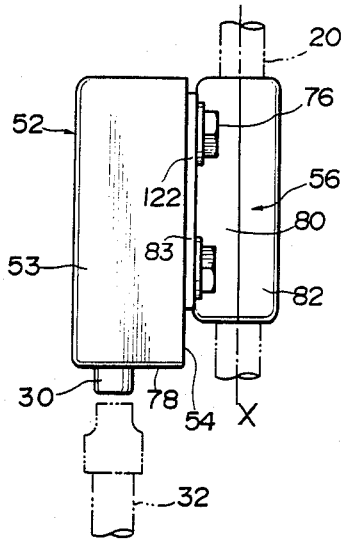
FIG. 12 is a side-elevational view of the cable connection assembly connected to the coaxial cable, showing another angular relationship between the cable tap connector and the transceiver.
Figure 13:
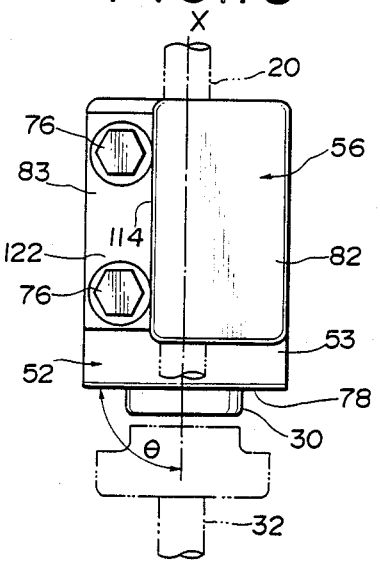
FIG. 13 is a front view of the cable connection assembly in FIG. 12.

In FIGS. 10 and 11, the drop cable 32 is disposed perpendicular to the coaxial cable 20, however, it is easy to change the drop cable's direction without bending the cable 32 and to extend the drop cable 32 from the transceiver 52 in another desired direction by achieving the following operations: for example, in order to lay the drop cable 20 in the direction parallel to the coaxial cable 20, the bolts 76 are unscrewed from the threaded holes 70 and 72; the transceiver 52 is turned at 90° with respect to the tap connector 56 without disengaging the receptacle 58 from the plug 106; the threaded holes, for example, 68 and 70 are aligned with the apertures 116 and 118 respectively; and again, as shown in FIGS. 12 and 13, the bolts 76 are screwed into the threaded holes 68 and 70 through the apertures 116 and 118.

As has been explained above, since the angle of the transceiver's lower face 78 relative to the axis of the tap connector's channel 87 is adjustable by turning the transceiver 52 with respect to the tap connector 56, the drop cable is enabled, without having itself being bent, to be disposed in a direction convenient for encasing the the branch connection within a usual joint box. Therefore, the cable connecting operation is considerably enhanced by utilizing the cable connection assembly according to the present invention.

Figure 14:
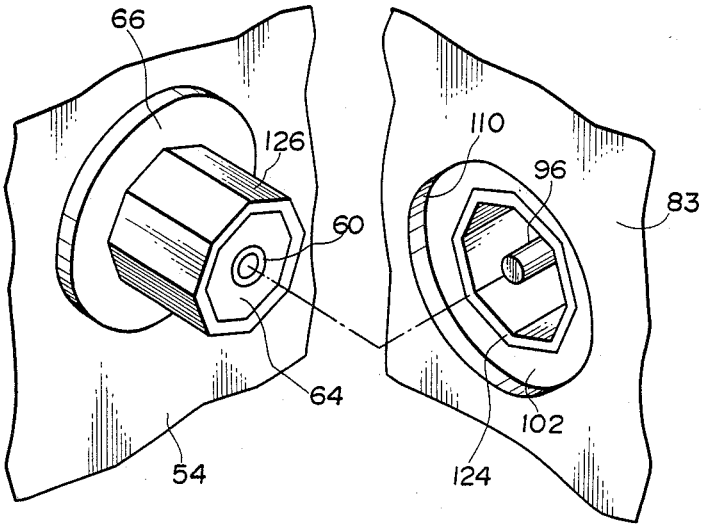
FIG. 14 is a fragmentary enlarged perspective view of a modified form of first and second coupling means in FIG. 6.
Figure 15:
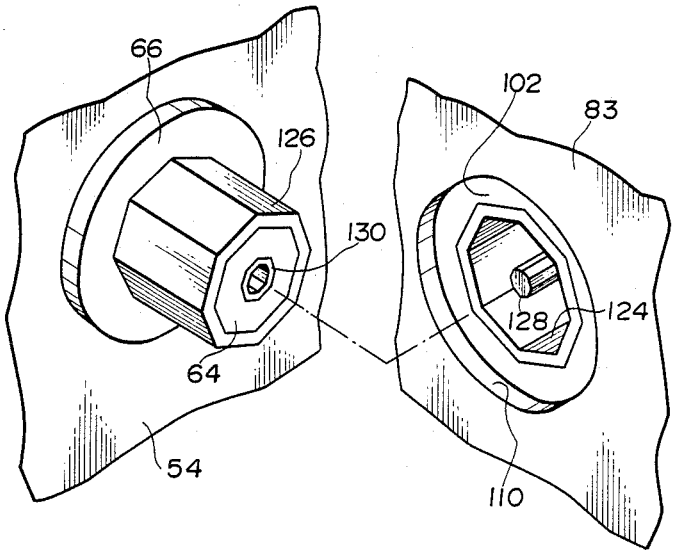
FIG. 15 is a fragmentary enlarged perspective view of another modified form of the first and second coupling means in FIG. 6.

It is understood that although a preferred embodiment of the present invention has been shown and described, various modifications thereof will be apparent to those skilled in the art. For example, it should be readily apparent that more than four threaded holes may be formed in the mating face 54 of the transceiver 52 so that more choice of directions in which the drop cable connector 30 is disposed is available. It should be also apparent that the transceiver may have a plug instead of the receptacle 58 and that the first housing member 80 may have a receptacle which is to be engaged with the plug of the transceiver 52. Furthermore, as shown in FIG. 14, first and second outer terminals 124 and 126 having similar equilateral polygonal cross sections may be employed in place of the first and second outer terminals 104 and 62. Also, as shown in FIG. 15, first and second center terminals 128 and 130 having similar equilateral polygonal cross sections may be employed in place of the first and second center terminals 96 and 60.

What is claimed is:

1. In a coaxial cable connection assembly for electrically connecting a coaxial cable used as a transmission medium to a station device, the cable connection assembly including: a cable tap connector for engaging with the coaxial cable, the tap connector having an axis along which the coaxial cable is disposed upon engagement with the tap connector, the tap connector having an outer face substantially parallel to the axis thereof and having outer and center conductor contact members for respective electrical connections with the outer and center conductors of the coaxial cable; a transceiver for transmitting and receiving information signals to and from, respectively, the coaxial cable via the cable tap connector, the transceiver having a casing, the casing having first and second faces in intersecting relationship; and a drop cable-connecting member mounted on the first face of the transceiver for electrically connecting the transceiver to the station device, the improvement comprising:

first and second matable coupling means, mounted respectively on the outer face of the cable tap connector and on the second face of the casing of the transceiver, for engaging and electrically connecting the transceiver with the cable tap connector such that the second face of the casing of the transceiver confronts the outer face of the cable tap connector and that the angle of the first face of the casing of the transceiver with respect to the axis of the cable tap connector is adjustable;

the first coupling means comprising:

(a) a first tubular outer terminal member electrically connected to one of the outer and center conductor contact members of the cable tap connector; and (b) a first rod-like center terminal member coaxially disposed in the first outer terminal member, the first center terminal member being electrically connected to the rest of the outer and center conductor contact members of the cable tap connector; the second coupling means comprising:

(c) a second tubular outer terminal member for coaxial and electrical connection with the first outer terminal member when the first and second coupling means are mated together, the second outer terminal member being electrically connected to the transceiver; and (d) a second rod-like center terminal member, coaxially disposed in the second outer terminal member, for coaxial and electrical connection with the first center terminal member when the first and second coupling means are mated together, the second center terminal members being electrically connected to the transceiver;

one of the first and second center terminal members having a tubular configuration so that the remainder of the first and second center terminal members coaxially fits in said one of the first and second center terminal members when the first and second coupling means are mated together;

one of the first and second outer terminal members having a transverse outer size such that said one of the first and second outer terminal members coaxially fits in the remainder of the first and second outer terminal members when the first and second coupling means are mated together; and each of the first and second outer terminal members and the first and second center terminal members having a circular cross section so that the first and second coupling means are rotatable with respect to each other when the first and second coupling means are mated together;

whereby the transceiver is turnable about the axis of the terminal members when the transceiver is engaged with the cable tap connector by the first and second coupling means mated together.

2. A coaxial cable connection assembly according to claim 1, further comprising securing means for securing the transceiver to the cable tap connector so that the first and second coupling means are retained in mating relation and that the angle of the first face of the casing of the transceiver with respect to the axis of the cable tap connector is retained in a specific angle.

3. A coaxial cable connection assembly according to claim 2, wherein the securing means comprises:

an insulation plate members, attached to the outer face of the cable tap connector, for electrically insulating the outer face of the cable tap connector from the second face of the casing of the transceiver; and attaching means for detachably attaching the insulation plate member to the second face of the casing of the transceiver.

4. A coaxial cable connection assembly according to claim 3, wherein the attaching means comprises:

a fastening member having proximal and distal end portions;

first engaging means for engaging the proximal end portion of the fastening member with the insulation plate member; and second engaging means for engaging the distal end portion of the fastening member with the transceiver.

5. A coaxial cable connection assembly according to claim 4, wherein the insulation plate has a plurality of apertures arranged at such positions that the distances between the axis of the first terminal members and the respective centers of the apertures are equal, wherein the first engaging means comprises the periphery of each of the apertures of the insulation plate member, and wherein the proximal end portion of the fastening member has a shape to engage with the periphery of any one of the apertures of the insulation plate member.

6. A coaxial cable connection assembly according to claim 5, wherein the second face of the casing of the transceiver has a plurality of threaded holes arranged at such positions that the distance between the axis of the second terminal members and each of the centers of the threaded holes is equal to the distance between the axis of the first terminal members and each of the centers of the apertures of the insulation plate member so that the apertures are alignable with the threaded holes of the transceiver casing when the first and second coupling means are mated together, wherein the second engaging means comprises the inner wall of each of the threaded holes of the transceiver casing, and wherein the distal end portion of the fastening member is threaded so as to engage with the inner wall of any one of the threaded holes of the transceiver casing.

7. In a coaxial cable connection assembly for electrically connecting a coaxial cable used as a transmission medium to a station device, the cable connection assembly including: a cable tap connector for engaging with the coaxial cable, the tap connector having an axis along which the coaxial cable is disposed upon engagement with the tap connector, the tap connector having an outer face substantially parallel to the axis thereof and having outer and center conductor contact members for respective electrical connections with the outer and center conductors of the coaxial cable; a transceiver for transmitting and receiving information signals to and from, respectively, the coaxial cable via the cable tap connector, the transceiver having a casing, the casing having first and second faces in intersecting relationship; and a drop cable-connecting member mounted on the first face of the transceiver for electrically connecting the transceiver to the station device, the improvement comprising:

first and second matable coupling means, mounted respectively on the outer face of the cable tap connector and on the second face of the casing of the transceiver, for engaging and electrically connecting the transceiver with the cable tap connector such that the second face of the casing of the transceiver confronts the outer face of the cable tap connector and that the angle of the first face of the casing of the transceiver with respect to the axis of the cable tap connector is adjustable;

the first coupling means comprising:

(a) a first tubular outer terminal member electrically connected to one of the outer and center conductor contact members of the cable tap connector; and (b) a first rod-like center terminal member coaxially disposed in the first outer terminal member, the first center terminal member being electrically connected to the rest of the outer and center conductor contact members of the cable tap connector; the second coupling means comprising:

(c) a second tubular outer terminal member for coaxial and electrical connection with the first outer terminal member when the first and second coupling means are mated together, the second outer terminal member being electrically connected to the transceiver; and (d) a second rod-like center terminal member, coaxially disposed in the second outer terminal member, for coaxial and electrical connection with the first center terminal member when the first and second coupling means are mated together, the second center terminal members being electrically connected to the transceiver;

one of the first and second terminal members having a tubular configuration so that the remainder of the first and second center terminal members coaxially fits in said one of the first and second center terminal members when the first and second coupling means are mated together;

one of the first and second outer terminal members having a transverse outer size such that said one of the first and second outer terminal members coaxially fits in the remainder of the first and second outer terminal members when the first and second coupling means are mated together; and the first and second outer terminal members having similar equilateral polygonal cross sections so that the first and second coupling means are matable with each other in more than three different relative angular relationships.

8. A coaxial cable connection assembly according to claim 7, wherein the first and second center terminal members have circular cross sections.

9. A coaxial cable connection assembly according to claim 7, wherein the first and second center terminal members have similar equilateral polygonal cross sections.

10. A coaxial cable connection assembly according to claim 7, further comprising securing means for securing the transceiver to the cable tap connector so that the first and second coupling means are retained in mating relation and that the angle of the first face of the casing of the transceiver with respect to the axis of the cable tap connector is retained in a specific angle.

* * * * *